US009290726B2

(12) United States Patent
Weller-Brophy et al.

(10) Patent No.: US 9,290,726 B2
(45) Date of Patent: Mar. 22, 2016

(54) LAUNDRY CLEANING PRODUCT

(71) Applicants: Laura A. Weller-Brophy, Pittsford, NY (US); Seth MacPherson Brophy, Pittsford, NY (US)

(72) Inventors: Laura A. Weller-Brophy, Pittsford, NY (US); Seth MacPherson Brophy, Pittsford, NY (US)

(73) Assignee: PureCap Laundry, LLC, Rochester, NY (US)

( * ) Notice: Subject to any disclaimer, the term of this patent is extended or adjusted under 35 U.S.C. 154(b) by 0 days.

(21) Appl. No.: 14/828,566

(22) Filed: Aug. 18, 2015

(65) Prior Publication Data

US 2015/0353872 A1 Dec. 10, 2015

Related U.S. Application Data

(62) Division of application No. 14/160,556, filed on Jan. 22, 2014, now Pat. No. 9,150,818.

(51) Int. Cl.

| | |
|---|---|
| ***C11D 9/38*** | (2006.01) |
| ***C11D 9/08*** | (2006.01) |
| ***C11D 9/40*** | (2006.01) |
| ***C11D 9/16*** | (2006.01) |
| ***C11D 9/12*** | (2006.01) |
| ***C11D 9/02*** | (2006.01) |
| ***C11D 11/00*** | (2006.01) |

(52) U.S. Cl.
CPC .. *C11D 9/40* (2013.01); *C11D 9/02* (2013.01); *C11D 9/12* (2013.01); *C11D 9/16* (2013.01); *C11D 11/0017* (2013.01)

(58) Field of Classification Search
CPC ..... C11D 3/386
USPC ..... 510/320
See application file for complete search history.

(56) References Cited

U.S. PATENT DOCUMENTS

| | | | | |
|---|---|---|---|---|
| 3,069,361 | A | 12/1962 | Cogswell | |
| 3,257,331 | A | 6/1966 | Jameston | |
| 4,247,424 | A | 1/1981 | Kuzel et al. | |
| 4,715,979 | A | 12/1987 | Moore et al. | |
| 4,808,320 | A | 2/1989 | Jacques | |
| 5,221,495 | A * | 6/1993 | Cao | 510/321 |
| 5,807,502 | A | 9/1998 | Wollenweber et al. | |
| 5,990,068 | A | 11/1999 | Brouwer et al. | |
| 6,020,303 | A * | 2/2000 | Cripe et al. | 510/503 |
| 6,093,856 | A * | 7/2000 | Cripe et al. | 568/625 |
| 6,376,446 | B1 | 4/2002 | Smadi et al. | |
| 6,610,645 | B2 * | 8/2003 | Pancheri et al. | 510/509 |
| 6,903,064 | B1 * | 6/2005 | Kasturi et al. | 510/433 |
| 2003/0186828 | A1 * | 10/2003 | Holderbaum et al. | 510/224 |
| 2004/0063598 | A1 * | 4/2004 | Riebe et al. | 510/293 |
| 2006/0194708 | A1 * | 8/2006 | Barthel et al. | 510/337 |
| 2007/0003502 | A1 * | 1/2007 | Tanabe et al. | 424/70.13 |
| 2007/0244026 | A1 * | 10/2007 | Barthel et al. | 510/445 |
| 2008/0004202 | A1 * | 1/2008 | Wolfgang et al. | 510/439 |
| 2009/0035337 | A1 * | 2/2009 | Artiga-Gonzalez et al. | 424/401 |
| 2014/0135250 | A1 * | 5/2014 | Weller-Brophy et al. | 510/320 |

OTHER PUBLICATIONS

"Love to Know Cleaning" web site with recipe for "Homemade Laundry Detergent" at web site http://cleaning.lovetoknow.com/Homemade_Laundry_Detergent/LaundrySoapRecipe.htm, Jul. 10, 2011.

* cited by examiner

*Primary Examiner* — Nicole M Buie-Hatcher
*Assistant Examiner* — M. Reza Asdjodi
(74) *Attorney, Agent, or Firm* — Louis S. Horvath

(57) ABSTRACT

The present invention relates to both stable liquid laundry cleaning compositions and dry powdered laundry cleaning compositions with good solubility in water. More particularly, this invention relates to a concentrated soap-based formulation to be mixed with a limited quantity of water in a mixing container to render an amount of dilute liquid laundry cleaning solution with lasting stability and good cleaning properties.

7 Claims, 4 Drawing Sheets

LAUNDRY CLEANING PRODUCT

CROSS REFERENCE TO RELATED APPLICATIONS

This application is a divisional of U.S. patent application Ser. No. 14/160,556, entitled "LAUNDRY CLEANING PRODUCT", filed Jan. 22, 2014, which is a continuation-in-part of prior U.S. patent application Ser. No. 13/136,377, entitled "LAUNDRY CLEANING PRODUCT," filed Jul. 29, 2011, the disclosure of which is incorporated herein by reference.

FIELD OF THE INVENTION

This invention relates to both stable liquid laundry cleaning formulations and dry powdered laundry cleaning formulations with good solubility in water. More particularly, this invention relates to a concentrated soap-based formulation to be mixed with a limited quantity of water by the consumer in a mixing container to render an amount of dilute liquid laundry cleaning solution with lasting stability and good cleaning properties.

BACKGROUND OF THE INVENTION

Over the past 50 years, laundry cleaner packaging and formulations have changed significantly, with predominately powdered cleaners in cardboard boxes replaced by liquid formulations in plastic containers. While the liquid formulations work well in cold water, and solve prior issues with powder clumping and inadequate dissolution in cold water, liquids pose their own problems. With the liquid formulations comprising significant amounts of water, the packages may be large and heavy, necessitating high transportation costs. Further, the liquid detergent packages require relatively large volumes of display space at stores, and commensurate storage after purchase by consumers. Additionally, the move from paper to predominantly plastic containers has resulted in recycling issues; whereas paper recycling, including cardboard, is widely available, plastic recycling remains limited, with plastic often ending up in landfills.

Prior to the introduction of liquid laundry cleaning formulations, powdered laundry cleaners were dissolved in 10 to 40 gallons of water in washing machines, with powder formulations often leaving clumpy white particulate behind, known as detergent stains. Detergent stains are more prevalent when the powdered laundry formulation is used with warm or cold water (water that is <130 deg F. in general). With modern washers, especially high efficiency washers, using from 15 gallons (high efficiency) to 23 gallons (industry standard) of water for the entire wash cycle, it has become increasingly necessary for more soluble solid powdered laundry detergents and soaps to be available, while increasing the desirability of liquid formulations. Additional problems with soap dissolution has become more pronounced with the use of cold water washing, as soap-based laundry products require hot temperature water for good dissolution.

With the desire on the part of consumers to reduce the energy costs associated with hot water laundry cleaning, consumers shifted to cold and warm water washing. In some parts of the world, cold water washing can refer to water temperatures that are in the range of 34 deg F. and greater. Cold and warm water washing have motivated the move to liquid laundry cleaners. These, however, have their own issues with dissolution and stability, with the relatively concentrated liquid laundry cleaners requiring additives, special orders of addition of constituents for the solutions to remain stable, and high shear mixing to put some constituents into solution.

The need for more soluble and stable laundry cleaning formulations has further led to a departure from soap-based surfactants and the adoption of poly-alkoxylated surfactants, typically incorporating medium to long chain alkanes, alchohols, alkylphenols, alkylphosphates, and alkylsulfonates. These surfactants are widely used in both dry powdered and liquid detergents such as those disclosed by Brouwer et al in U.S. Pat. No. 5,990,068 ("Powder Detergent Composition Having Improved Solubility," 1999) and Wollenweber et al in U.S. Pat. No. 5,807,502 ("Aqueous Fatty Alcohol Dispersions," 1998). Brouwer et al disclose detergent compositions that incorporate synthetic surfactants containing from 3 to 80 ethoxy groups, and necessitating a quantity of fumaric acid as an acidulant to further boost solubility. Wollenweber et al disclose liquid detergents that incorporate both long chain fatty alcohols and alkanes with from 5 to 50 ethoxy groups with both surfactants being necessary to improve solution stability.

Detergents have employed both physical and chemical methods to increase solubility and stability. Dry powders are made with a spray-dried granule method to increase the speed of dissolution of relevant surfactants and builders. As disclosed by Moore et al in U.S. Pat. No. 4,715,979 ("Granular Detergent Compositions Having Improved Solubility," 1987), spray-dried granules incorporate multiple concentric layers of constituents with each layer having an increasing surface area that enhances reactivity with the constituents of other layers upon exposure to water. The granular detergent compositions disclosed by Moore et al contain from about 30% to about 85%, by weight of a mixture of C11-C13 alkylbenzene sulfonate surfactant and C12-C16 alkyl sulfate surfactant in a weight ratio of sulfonate surfactant to sulfate surfactant of from about 4:1 to about 1:4.

As the concentration of surfactants has increased in liquid laundry cleaners, solution stability has become an issue with problems of gelation and separation of liquid ingredients. Smadi et al in U.S. Pat. No. 6,376,446 ("Liquid Detergent Composition," 2002) address synthetic detergent compositions to overcome limited solution stability. They disclose a synthetic laundry detergent comprising a) an anionic surfactant at a concentration from about 5% to about 55% on a weight percentage basis; b) a nonionic surfactant at a concentration from about 10% to about 55% on a weight percentage basis; c) an alkylamine ethoxylate surfactant at a concentration from about 5% to about 55% on a weight percentage; d) a polyalkylene glycol at a concentration from about 1% to about 25% on a weight percentage basis, wherein the polyalkylene glycol has a molecular weight ranging from about 100 to about 5000; and e) an alkylamine. The liquid detergent is phase stable so that gelation and/or visual phase separation does not occur, incorporating surfactants at a concentration of at least 30% on a weight percentage basis. Smadi et al are silent on liquid formulations where soap-based surfactants are utilized. Smadi et al further disclose that their liquid formulations are not stable when the components of the formulation are simply mixed (a simple mixing process includes adding water to the remaining liquid detergent ingredients in one step and then mixing by stirring or shaking); their Example 9 discloses formulations according to their invention that, when mixed together, do not yield stable solutions. They detail orders of addition and mixing methods (high shear mixing, for example) that are successful to produce the stable solutions of their invention (Column10: lines 8-45, and Example 1).

U.S. Pat. No. 4,247,424, "Stable Liquid Detergent Compositions," issued to Allen et al (1981), discloses liquid detergent compositions which contain an ethoxylated alcohol or ethoxylated alkyl phenol nonionic surfactant, an amine oxide surfactant, a water-soluble detergency builder, a hydrophobic emulsifier and water, with the resulting liquid detergent compositions being stable emulsions. A critical element in the formulation of the stable liquid detergent compositions is the selection and use of a hydrophobic emulsifier. Emulsifiers that are suitable for the stable liquid detergent compositions include lecithin. Allen et al disclose that "the level of hydrophobic emulsifiers required to maintain emulsion stability depend on the nature and level of other ingredients, particularly the ethoxylated nonionic surfactant. A preferred level is from about 5% to about 16% by weight of the total composition". As disclosed by Allen et al, the detergent formulation provides a precisely controlled chemical environment with very few alkaline metal ions; this is an environment that is optimal for lecithin to function as an emulsifier. Allen et al are silent as to the use of lecithin as an emulsifier in other detergent compositions. Allen et al implicitly teach against the use of lecithin in laundry cleaners that consist entirely of soap-based surfactants by disclosing only surfactant systems that provide a chemical environment with very few alkaline metal ions; soap-based surfactant systems are rich in alkaline metal ions.

Some liquid fabric softeners and laundry detergents incorporate lecithin and lecithin-like compounds in their formulations. Lecithin is added to a fabric softening formulation to act as an organic softening agent, as noted in U.S. Pat. No. 4,808,320A (Alain Jacques and Patrice Pirotton, "Fabric softening compositions based on lecithin and methods for making and using same"). The dispersion of lecithin in an aqueous medium is, however, notably difficult with several references pointing out that the simple mixing of lecithin with an aqueous solution does not successfully lead to dispersion of the lecithin. Such references propose the addition of an emulsifying agent, such as noted in U.S. Pat. No. 3,257,331A (Richard Jameston and Russell Eversole, "Lecithin composition"). Jameston and Eversole note that lecithin is neither soluble nor readily dispersible in water, and teach the addition of an oil emulsifier containing ethylene oxide. U.S. Pat. No. 3,069,361A (George Cogswell, "Water-dispersible lecithin") similarly addresses the difficulty of dispersing lecithin in aqueous solutions, and teaches the addition of phenoxypolyalkylated alchohols as a dispersion agent.

Lecithin has been suggested as a possible, though not ideal, emulsifying agent, as in U.S. Pat. No. 4,247,424 (Allen et al, "Stable liquid detergent compositions"). The use of lecithin as an emulsifying agent is limited, however, to liquid detergent solutions which include ethoxylated nonionic surfactants. The liquid detergent solutions have a chemical environment with very few alkaline metal ions, an environment virtually required for the lecithin's function as an emulsifier and its continued stability. Allen et al teach against the use of lecithin in a liquid laundry cleaner that is rich in alkaline metal ions, and do not suggest that such use of lecithin would produce a stable liquid solution in an alkaline metal ion rich environment. Implicitely, Allen et al teach against the use of lecithin in a soap-based formulation, as soaps produce an alkaline metal rich environment.

A soap-based laundry cleaner mix, route to market, mixing method, and kit are presented in U.S. patent application Ser. No. 13/136,377, entitled "LAUNDRY CLEANING PRODUCT," incorporated herein by reference. The laundry cleaner formulation of that invention comprises a dry powder and/or particulate mixture to be added to water to form a liquid laundry cleaner in a mixing container. The dry mixture comprises enzymes such as protease and amylase, soap (acting as a detergent and surfactant), borax decahydrate (acting as a builder and a buffer), and sodium carbonate monohydrate (acting as a builder). The soaps of that invention include sodium salts of carboxylic acids, with the soaps comprising those made via hot processes (boiled and semi-boiled) as well as those made using cold processes. The laundry cleaner formulations that are presented as examples in U.S. patent application Ser. No. 13/136,377 are developed so that when mixed with water in a mixing container, the dry formulation dissolves upon shaking or stirring. It is noted that the laundry cleaner formulations of U.S. Ser. No. 13/136,377 may include emulsifiers (see US 2012/0031804 A1, para 0030, for example).

Laundry cleaner formulations and methods of mixing have been disclosed beyond the patent arts (for example, "LoveToKnow Cleaning" web site with recipe for "Homemade Laundry Detergent"). These formulations consist of dry ingredients that are added to water to form liquid laundry cleaning solutions. Ingredients consist of grated soap (Fels Naptha, most commonly), Borax, and Washing Soda. The method of mixing requires the soap to be melted in water, over heat, with the remaining dry ingredients added and simmered in the liquid to assure mixing. Limitations of such formulations and methods include 1) the dry ingredients and water must be heated to enable adequate mixing; 2) the resulting colloidal emulsion is heterogeneous, with aggregation of gels that make the solution difficult to pour; and 3) the emulsion that results from the addition of the dry ingredients with water may become unstable with particulates falling out of suspension.

PROBLEM TO BE SOLVED

Liquid laundry cleaners that consist largely of water pose disadvantages, with packaging that is large and heavy, necessitating high transportation costs, and requiring relatively large volumes of display space at stores, with commensurate storage after purchase by consumers. Such disadvantages have been addressed by the development of liquid concentrates, where packaging size and weight are reduced. Concentrates, however, may pose health hazards to consumers if they contact skin or mucosal membranes during use. They also can be readily misused by consumers, and may be added to laundry wash loads at higher doses than are necessary. Such over-dosing can lead to residual detergent in cleaned laundry, resulting in allergic reactions/dermatitis upon prolonged contact of the washed items with skin surfaces. Over-dosing also increases the per-load cost of use of the laundry cleaning product.

Laundry cleaner concentrates that are added to water in a mixing container by the consumer may provide an attractive solution to these problems. However, such laundry cleaner concentrates can have issues with solubility and stability upon mixing with water. Such issues of solubility and stability have been addressed for liquid laundry cleaners that are manufactured in an industrial setting through the use of high shear mixing and with the liquid laundry constituents added in a precise and well-defined order so to maintain stability.

The literature is silent as to means for solving solubility and stability issues that arise when laundry cleaning concentrates are simply added to water in a mixing container and shaken and/or stirred by consumers to yield a container of liquid laundry cleaner at a desired dilution. In specific, the literature does not address the solubility and stability of liquid laundry cleaners that are made through the simple mixture of a dry powder/particulate mix/concentrate with water in a mixing container, with the dry concentrate and water added to each other and stirred or shaken by hand to mix.

The difficulties inherent in the formulation of a soap-based powder that not only is highly soluble in water but also produces a stable emulsion are many and well known to those practiced in the art. Additionally, incorporating multiple enzymes into the mixture and subsequent emulsion provides further challenges in ensuring their continued active state and preventing denaturing in solution over time.

It is an object of this invention to provide a stable liquid laundry cleaner composition which has beneficial cleaning characteristics, including cold and warm water detergency characteristics. It is a further object of this invention to provide a compatible, multi-component, liquid laundry cleaning composition in the form of a stable emulsion, wherein the stable emulsion does not incorporate ethoxylated nonionic surfactants.

It is yet another object of this invention to provide mixtures of laundry cleaning compounds in a convenient dry concentrated form.

These and other objects can be achieved by the compositions of the invention and related methods of mixing as hereinafter described.

SUMMARY OF THE INVENTION

This invention relates to a laundry cleaning product comprising one or more containers of concentrated, premeasured, ready-to-mix constituents that are simply mixed without the use of heat to yield a container of dilute liquid laundry cleaner. The invention comprises a laundry cleaner mix that is easy to mix with water, requiring no heating or simmering using an externally applied heat source, includes effective soil and stain removers, such as enzymes and surfactants, and may be mixed into a variety of volumes, through the mixture of the laundry cleaner mix and water.

The formulations of the present invention span all-natural compositions as well as those incorporating manmade cleaning agents, stabilizers, and other constituents. The formulations are developed to be mixed with water, and preferably with warm or hot water, without the need for heating. The formulations are developed to be mixed in a mixing container, wherein the mixing container holds a volume of the resulting liquid laundry cleaner that is sufficient to be added to more than one load of laundry to be washed in a washing machine.

The invention further relates to a laundry cleaner product wherein the laundry cleaner formulations include powdered soap with soap particles that have no physical dimension larger than 2 mm, and preferably no larger than 1 mm.

The invention also relates to a concentrated laundry cleaning mix consisting of ingredients that are in the forms of powders, granules, and/or flakes. This concentrated laundry cleaning mix is meant for mixture in warm water in a mixing container or bottle for the production of a dilute liquid laundry cleaner. Warm water refers to readily accessible water that has no set requirements on filtration and is between 80 degrees Fahrenheit and 130 degrees Fahrenheit, and the resulting dilution refers to one which requires 2 fluid ounces or more of resultant liquid laundry cleaner per standard load of laundry.

The invention includes a blended laundry cleaner concentrate/mix containing 15% to 50% by weight of a boron-containing anionic builder. The concentrate/mix also contains a carbonate or percarbonate builder in amounts of from 20% to 70% by weight. Both builders may preferably be introduced as alkali metal salts. Additionally, the blended concentrate/mix contains from 5% to 20% by weight of a soap produced from one or more vegetable oils. A suitable soap is defined as the sodium salt of a medium-chain linear carboxylic acid that is saturated, mono-unsaturated, or di-unsaturated. The soap preferably consists of at least 1 part in 10 by molar ratio of glycerin, a glycerin analogue, a product of a synthesis in which glycerin was a reactant, or a product of a synthesis in which a glycerin analogue was a reactant.

The laundry cleaning formulation may also contain an emulsifier in addition to the soap, wherein the emulsifier and soap are present in a soap:emulsifier weight ratio from 10:1 to 1:1. The laundry cleaning formulation preferably contains a lecithin emulsifer in amounts of from 1% to 20% by weight. The concentrate/mix also may contain a blend of enzymes, which may include an amylase which is present in the blend in amount of 0% to 20% by weight, and a protease which is present in the blend in amount of 0% to 20% by weight, which enzymes combined should make up no more than 30% by weight the final mix. The concentrate/mix is notable in that it does not contain ethoxylated nonionic or ionic surfactants, yet still will form an emulsion upon simple mixing with water.

Upon mixing the mix/concentrate with warm water, the resulting colloid consists of about 75% to 98%, and preferably from 92% to 98% water by weight. This dilute aqueous mixture solves the problem of liquid laundry detergent overdosing by allowing for measuring of larger amounts of fluid for a single wash load, preferably 2 fluid ounces or more per wash load. The 2 fluid ounces or more that are used per washload may be readily measured and poured using a measuring cap that may be provided with the mixing container. Additionally, the dilute mixture reduces the sudsing of the wash water in combination with the anti-sudsing properties of the lecithin, allowing for greater impact and mixing of fabrics with the wash water, providing a more thorough cleaning.

The present invention uses fatty acid chains of C8-C18, more preferably C12-C16, most preferably saturated acid chains of C12-C14. The laundry cleaning concentrate/mix, when added to water, may separate into an emulsion layer with a separate, largely aqueous layer. The composition of the concentrate/mix with water produces an emulsion of sufficiently high density (especially once paired with the emulsifier) to sink in the aqueous portion of the colloid as necessary to form a stable (or readily re-stabalized with the introduction of minor kinetic energy) emulsion. It is the shorter medium chain saturated fatty acids (C12-C14) that form an emulsion layer denser than water. This is important, as we have found that an emulsion layer that floats on a separate aqueous layer will ultimately begin to cross-link and salt-out. Emulsion layers that are denser than water have been found to be readily remixed with the water layer through shaking/mixing, without cross-linking or salting-out of the emulsion layer.

The inventive laundry cleaner preferably includes an emulsifier with surfactant properties composed of a glycerol backbone with no fewer than two side chains, with at least one being a medium to long chain carboxylic acid with good hydrophobic properties, and at least one having moderate hydrophillic properties, preferably of an amphoteric and/or zwitterionic nature. More preferably, this emulsifying agent's chemical composition should resemble that of a lecithin, most preferably that of a soya lecithin.

Advantageous Effect of the Invention

The present invention includes several advantages, not all of which are incorporated in a single embodiment. The inventive laundry cleaning formulation comprises a dry powder/particulate mix that, when added to water in a mixing container, yields an emulsion without aggregate formation. The invention further provides a laundry cleaner formulation with good cleaning in cold water, ease of compact packaging that can be reused and/or recycled, lightweight packaging, is a sufficiently dilute solution when in liquid formulation so that measurement accuracy is not critical, is easy to mix, requiring no heating or simmering using an externally applied heat source, can include effective soil and stain removers such as enzymes, and can be mixed into a variety of volumes without the need to make overly large amounts at any one time.

The invention includes a laundry cleaner formulation that produces a stable colloid when introduced to water without the need to provide an external heat source to aid in dissolution or incorporation of the formulation into the water. The invention does this without the use of structurants that would encourage lattice formation in solution (for example, structurants include smectic clays, amido-gellant, and crystalline fatty esters). The aqueous solution with dissolved laundry cleaner formulation is defined as being stable under the following conditions, all of which must be met for a period of at least 30 days after introduction of the laundry cleaner formulation into a prescribed volume of water; a). the laundry cleaner formulation remains dissolved or incorporated in the aqueous solution; b) the solution retains the ability to clean clothes in so far as it retains the ability to visibly reduce or eliminate stains and dirt in laundry without losing cleaning efficiency; c) solid or gel aggregates do not form in the aqueous solution; d) while the solution may separate into 2 or more liquid phases, these are readily mixed upon shaking; and e) the solution remains able to be poured.

DETAILED DESCRIPTION OF THE INVENTION

Figure 1:
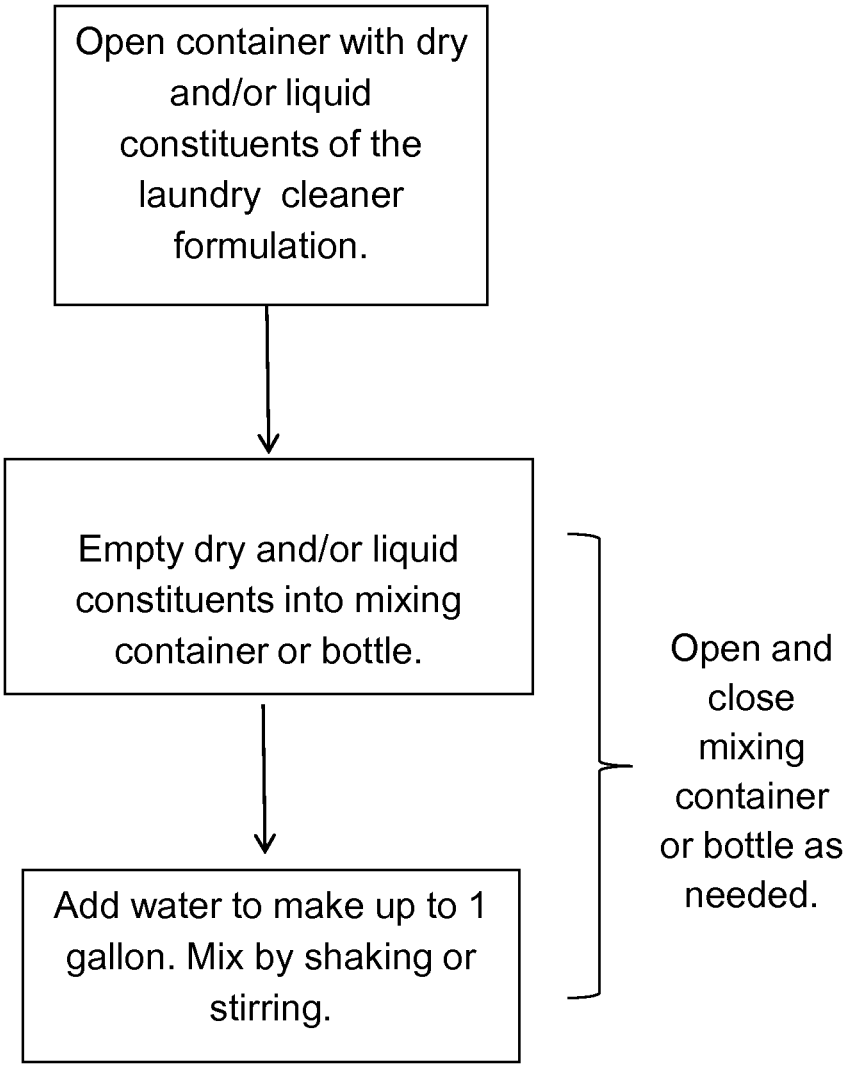
FIG. 1. This figure illustrates a first method of mixing the constituents of a laundry cleaner formulation/mix with water.

The invention described herein consists of a laundry cleaning product, and more specifically a concentrated laundry cleaner formulation including constituents to be mixed with water by shaking or mixing by hand in a mixing container or bottle. The invention further includes a method for mixing the constituents into a liquid laundry cleaner. The invention further consists of the dilute liquid laundry cleaner for home use that is formed from the addition of water to the ready-to-mix laundry cleaner formulation.

As used herein, the term "soap" means the sodium salts of carboxylic acids ranging from C6 to C20, resulting from the saponification of triglyceride fats.

For the sake of clarity, a "detergent" is a soap-like emulsifer that contains a sulfate, $SO_3$ or a phosphate group instead of a carboxylate group. This definition separates soaps from detergents, as soaps contain a carboxylate group.

The term "emulsion", as used herein, means a colloidal suspension of a dispersed liquid or particulate phase in a liquid. A colloidal system generally consists of two separate phases: a dispersed phase (or internal phase) and a continuous phase (or dispersion medium) in which the colloid is dispersed. Further as used herein, an "emulsifying agent" is a substance that coats the liquid or particles of the dispersed phase and prevents coagulation of colloidal particles; an emulsifying agent is also termed an emulsifier.

The term "slurry", as used herein, means a watery mixture of insoluble matter.

The nouns "mix", "concentrated mix", "concentrate", "laundry cleaner formulation", and "laundry cleaner mix" are used interchangeably herein.

As used herein, "liquid laundry cleaner" refers to the liquid that results from the mixing of the "mix" with water, in a mixing container or bottle.

Further, as used herein, a "mixing container or bottle" refers to an article consisting of a container or bottle that holds up to 1 fluid Gallon, and is the article in which the "mix" and water are added to each other and mixed.

The verb "mix", as used herein, refers to actions such as stirring or shaking that are done by hand, without the benefit of powered equipment such as shear mixers, automated shakers, powered stirrers, or powered blenders.

The Laundry Cleaner Mix

The invention comprises a concentrated laundry cleaner mix containing constituents that include 15% to 50% by weight of a boron-containing anionic builder. The mix also contains a carbonate or percarbonate builder in amounts of from 20% to 70% by weight. Both builders may preferably be introduced as alkali metal salts. Additionally, the mix contains from 5% to 20% by weight of a soap; preferred soaps are produced from vegetable oils. The soaps used in this invention are preferably powders that comprise finely dispersed solid particles having particle sizes less than 2 mm in the longest dimension, and preferably less than 1 mm in the longest dimension.

The laundry cleaner mix may further include an emulsifier, and preferably contains a lecithin in amounts of from 1% to 20% by weight. The mix further may incorporate a blend of enzymes, which may include an amylase which is present in the blend in amount of 0% to 20% by weight, and a protease which is present in the blend in amount of 0% to 20% by weight, which combined should make up no more than 30% by weight the final mix. Preferably, the laundry cleaner mix is a free flowing powder, flake, granular, or particulate formulation. Liquid additives may be separately packaged with the concentrated mix for use in reconstituting the desired liquid laundry cleaner. Such additives may include, but are not limited to; surfactants, water softeners, emulsifiers, and other agents to aid dissolution of components and mixing. Other ingredients can be included, such as those disclosed in the washing or cleaning formulations of U.S. Pat. Publ. 2008/0004202 to Wolfgang et al., filed Jan. 3, 2008, incorporated herein by reference.

The Liquid Laundry Cleaner Made from the Laundry Cleaner Mix with Water

Upon shaking, stirring or otherwise blending the concentrated mix with water having a temperature of up to 130° F., the resulting colloid should ideally consist of 75% to 98% water by weight, and preferably from 92%-98% by weight. This dilute aqueous mixture addresses the problem of liquid laundry cleaner over-dosing by allowing for the measurement and dosing of from about ¼ cup to over 1 cup of dilute liquid laundry cleaner into a wash load. In specific, the dilute liquid laundry cleaner that results from the addition of the concentrated mix with water, is meant to be used in volumes preferably of 2 fluid ounces (¼ cup) or more per wash load. The exact volume of dilute laundry cleaner to be used per wash load may be adjusted by the amount of water that is added to the concentrated mix by the end user. In this manner, the user has the ability to customize the dilution of the liquid laundry cleaner so to allow the measurement of more or less liquid laundry cleaner into a load of laundry. Whereas very concentrated laundry cleaning liquids require precise measurement due to the relatively small volume measures that are required, more dilute laundry cleaning liquids require less precision, making them easier to measure without over-dosing in a single load of laundry. By reducing the over-dosing of the liquid laundry cleaner, one reduces the opportunity for residual laundry cleaner in fabrics after rinsing. Additionally, the dilute mixture reduces the sudsing of the wash water in combination with the anti-sudsing properties of the lecithin, allowing for greater impact and mixing of fabrics with the wash water, providing a more thorough cleaning Other additions to the laundry cleaning formulations may include mixing beads or other mechanical aids to mixing.

The laundry cleaning formulation is preferably modified through the addition of one or more enzymes in liquid and/or powder form to enhance the cleaning properties. The enzymes may include proteases, amylases, cellulases, and custom blends of these or other enzymes used to enhance the cleaning performance. A limitation of adding a powdered enzyme in the laundry product is the potential for the enzyme to react with the other laundry cleaning ingredients upon the addition of water and mixing. Through experimentation, we have identified enzymes that do not suffer from clumping, gel-formation, and difficult dissolution when combined with the soap and other constituents of the laundry cleaner mix as described above. In specific, the powdered "Clean Power" sold by Genencorp readily dissolves into our cleaning formulations when water is added and the mixture shaken, without forming gels or clumps. The "Clean Power" product consists of a blend of protease and amylase. This blended enzyme, when used in the laundry cleaner mix, dissolves readily with the other components of the formulation.

Other enzymes used in the formulation may include the "SEBrite" products sold by the Specialty Enzymes and Biochemicals Co., California, USA. In specific, the SEBrite LP and BP powdered enzymes may be used at the loadings noted in the examples. The loadings area for a blend of the LP and BP products, with the blend designed to provide the optimal performance; preferably, the LP and BP enzymes are blended in a 2:1 ratio, LP:BP. It was found, however, that the SEBrite LP and BP powered enzymes caused gels to form in the liquid laundry cleaners after being mixed. The "Clean Power" product did not produce gels, resulting in a liquid laundry cleaning solution that poured readily, even after being mixed for several weeks.

Liquid enzymes may also be used at loadings similar to those noted here for the powdered enzymes. The final amount of enzyme is determined by its activity and concentration as purchased.

Preferred Soap Constituents

The soap constituent(s) included in the laundry cleaner mix is (are) preferably the sodium salt(s) of one or more medium-chain carboxylic acids that are saturated, mono-unsaturated, or di-unsaturated. The soap or soaps preferably consist of at least 1 part in 10 by molar ratio of glycerin, a glycerin analogue, a product of a synthesis in which glycerin was a reactant, or a product of a synthesis in which a glycerin analogue was a reactant.

Soaps that have been used in example concentrated mixes include those listed in Table 1. Talloates, supplied by Bradford Soapworks, Inc, West Warwick, R.I., include the TS 101 and Supreme 101 Soap Powders. These talloate-based soaps are manufactured using a hot process where glycerin is retained in the soap. In a series of examples, an approximately 6 g amount of one of the soap powders is blended with approximately 17 g of washing soda (carbonate monohydate), and 11 g of Borax (borax decahydrate). The mixture of the dry powder soap, washing soda, and Borax is termed the "concentrated mix". To this mix is added approximately 4 fluid ounces of water at a temperature of about 114° F. Each of the TS 101 and Supreme 101 soap-based concentrated mixes fails to dissolve in the water after vigorous mixing (shaking for at least 30 seconds in a closed mixing bottle). After approximately 24 hours, the solutions appear to gel/cross-link, becoming very viscous; these viscous solutions are difficult to pour.

Various cold process olive oil-based soaps were also evaluated in the concentrated mixes. Cold process soaps retain the glycerin that is formed during the saponification process, whereas glycerin is commonly removed from hot process soaps. The olive-oil-based soap laundry cleaner mixes dissolve readily in warm water (about 114° F.) when shaken vigorously by hand. In some cases, the resulting solutions are milky and do not separate over time. In most cases, however, the solutions aggregate into clumps and gels, in some cases forming a dense layer of material floating on top of an aqueous solution. The stability of the resulting liquid laundry cleaner varies from batch to batch of the cold process soap; variability in the degree of saponification, and superfatting, as well as unexpected pockets of unmixed caustics are considered to contribute to the variations noted when the cold process soaps are used in the concentrated mixes.

TABLE 1

Comparison of example soap constituents with no addition of lecithin.

| | No lecithin added | | | |
|---|---|---|---|---|
| | Dissolution | Clumping/gel formation | Separation | Comments |
| Talloates (glycerine remains) | Do not dissolve | NA | NA | Not useful as soap does not dissolve |
| Olive Oil Soap (glycerine remains) | Dissolves well in water | Forms gels and clumps; can crosslink | Aggregated materials separate from solution | Stability varies with specific soap batch. Aggregation into clumps/gels is common and makes dispensing liquid solution difficult. |
| Cocoate (10% glycerol by vol) | Dissolves very well in water | May form gels and clumps; can salt out | Emulsion/clear liquid separation is typical | Stability is poor; aggregates make dispensing liquid solution difficult. Solutions that salt out are not useful. |

TABLE 1-continued

| Comparison of example soap constituents with no addition of lecithin. | | | | |
|---|---|---|---|---|
| | No lecithin added | | | |
| | Dissolution | Clumping/gel formation | Separation | Comments |
| Cocoate/Palmate (40/60) (glycerine stripped) | Dissolves very well in water | May form gels and clumps; can salt out | Emulsion/clear liquid separation is typical | Stability is poor; aggregates make dispensing liquid solution difficult. Solutions that salt out are not useful. |

Hot process cocoates and cocoate/palmate soaps were also incorporated into the concentrated mixes. A Bradford Soap Works, Inc. Sodium Cocoate Soap Base with approximately 10 vol % retained glycerol (approximately 6 g of the dry soap base) is blended with approximately 17 g of washing soda, and 11 g of Borax. To this mix is added approximately 4 fluid ounces of warm water (approximately 114° F.). While the concentrated mix of soap, Borax, and Washing Soda dissolves very well with the water upon shaking by hand, the resulting emulsion can separate over time. In some cases, this separated emulsion forms aggregates, gels, and can become very viscous within 24-48 hours of mixing.

A hot process 60/40 Palmate/Cocoate Soap Base having no residual glycerin (Twincaft Soap, Winooski, Vt.) was used in a concentrated mix as described above. When shaken with water, the solutions are unstable, forming gels and aggregates.

In general, the laundry cleaner mixes with soaps having little or no residual glycerin form emulsions when shaken with water to mix, but these emulsions may separate within 24-48 hours and aggregate, salt out, and/or gel. The soaps that incorporate glycerin tend to form more stable emulsions when mixed with water, but these also may separate over time, and form gels, salt out, and/or form aggregates.

To address stability of the emulsion that forms when the concentrated soap-based mix is added to water, various emulsifiers have been evaluated in the dry concentrated mixes. Such emulsifiers include soya lecithin, gelatin, and guar gum. A concentrated mix was formulated with 6 g. of olive-oil-based soap added to 3 g gelatin, 11 g Borax, and 17 g Washing Soda. This concentrate was mixed with 14 fluid ounces of warm water (approximately 114° F.) by vigorous shaking by hand. The resulting emulsion separated, with a gelled layer forming on top of an aqueous solution layer.

A series of trials were run with guar gum added to solutions that were formed one day earlier from the concentrated mixes. The guar gum was added in a similar weight % as the gelatin. The use of the guar gum does not improve the stability of the resulting solutions.

Lecithin was also trialed as an aide to improve emulsion stability. While lecithin has been incorporated into laundry softeners and some detergents, the literature is silent on its role as a stabilizer in soap-based laundry formulations. Table 2 summarizes results obtained when soya lecithin is added to laundry cleaner mixes of the current invention. In all cases with the vegetable oil-based soaps, the addition of soya lecithin significantly improves the stability of the resulting emulsion.

Concentrated mixes made with the Cocoate/Palmate soap and lecithin yield surprising results based upon the exclusion or addition of glycerin to the liquid laundry cleaner solution. In contrast to several of the other soaps used in our trials, the Cocoate/Palmate soap, manufactured by a hot process, is stripped of glycerin. [Note: in both hot and cold soap making processes, dissolved lye and warmed fats are mixed and stirred, with the mixture thickening through the saponification process. Hot processes include steps where the glycerin by-products of the saponification reaction are removed prior to solidification of the soap. Cold processes produce solid soaps that retain the glycerin.] Concentrated mixes based on the Cocoate/Palmate soap yield emulsions that have reduced stability when mixed with water, even when lecithin is added to the concentrated mix. When glycerin is added with a glycerin:dry soap weight ratio of approximately 1:15, the stability of the emulsion is improved. Whereas the emulsion that incorporates lecithin has a stability of less than a week without the glycerin, the addition of the glycerin increases the stability of the emulsion to one or more weeks.

TABLE 2

| Comparison of example soap constituents with the addition of lecithin. | | | | |
|---|---|---|---|---|
| | Lecithin added | | | |
| | Dissolution | Clumping/gel formation | Separation | Comments |
| Talloates (glycerine stripped; residual unknown) | Do not dissolve | NA | NA | Not useful as soap does not dissolve |
| Olive Oil Soap (glycerine unstripped, % unknown) | Dissolves well in water | No clumps or gels | Solutions can remain fully emulsified for more than 6 months | Solutions may separate into an emulsion layer with a transparent liquid layer on top. These 2 layers are readily mixed by shaking; mixed solution remains stable for weeks/months without shaking. |
| Cocate (glycerine >9%) | Dissolves very well in water | No clumps or gels | Solutions can remain fully emulsified for 30 days. | Solutions separate into an emulsion layer with a transparent liquid layer on top. These 2 layers are readily mixed by shaking; mixed solution remains stable for days/weeks without shaking. |

TABLE 2-continued

| Comparison of example soap constituents with the addition of lecithin. | | | | |
|---|---|---|---|---|
| | Lecithin added | | | |
| | Dissolution | Clumping/gel formation | Separation | Comments |
| Cocoate/Palmate (40/60) (glycerine stripped, <1%) | Dissolves very well in water | No clumps or gels | Solutions separate within several days of mixing. | Solutions separate into an emulsion layer with a transparent liquid layer on top. These 2 layers are readily mixed by shaking; mixed solution remains stable for days without shaking. |
| Cocoate/Palmate (40/60) glycerine added | Dissolves very well in water | No clumps or gels | Solutions can remain fully emulsified for 30 days | Solutions may separate into an emulsion layer with a transparent liquid layer on top. These 2 layers are readily mixed by shaking; mixed solution remains stable for days/weeks without shaking. |

Review of the stability data from trials with glycerin-rich soaps confirm the surprising result that the addition of lecithin to the concentrated mix with a glycerin-rich soap yields significant enhancement of the stability of the emulsion that results from the addition of water to the concentrated laundry cleaner mix. In all cases, the liquid laundry cleaning emulsions that incorporate both the lecithin and glycerin-rich soaps undergo only limited separation, and are readily remixed by gentle shaking. These solutions do not experience aggregation or gel formation, but remain free flowing liquids with a relatively low viscosity. Most solutions remain stable for 30 days without separation of an emulsion and aqueous layer; some solutions remain fully mixed and stable for over 11 months without shaking.

The Role of Lecithin

The lecithin acts both as a surfactant as well as an emulsifier, stabilizing the colloid formed by the soap in the water along with the borax and soda through the actions of its polar and nonpolar groups. The lecithin is used in the laundry cleaning formulation with a soap:lecithin weight ratio from 10:1 to 1:1. Preferably the lecithin is a soya lecithin.

While the incorporation of an emulsifier such as lecithin supports the formation of an emulsion in the soap-based laundry cleaning formulations described herein, it has been found that the soaps are preferably those that include at least 1 part in 10 by molar ratio of glycerin relative to the fatty acid content of the soap. The glycerin acts as a fabric softening agent but, more surprisingly, is found here to stabilize the lecithin and prevent its degradation into fatty acids and glycerin in the basic environment of the liquid laundry cleaning mixture. Together, the lecithin and glycerin have been found to prevent the aggregation of solids in the colloid as well as to prevent the emulsion from breaking and particulates falling out of suspension.

The Laundry Cleaning Formulation—The Concentrated Laundry Cleaner Mix

Our invention uses fatty acid chains of C8-C18, more preferably C12-C16, most preferably saturated acid chains of C12-C14. The composition having a high enough density (especially once paired with the emulsifier) to sink in the aqueous portion of the colloid is necessary for a stable (or readily re-stabalized with the introduction of minor kinetic energy) emulsion. It is the shorter medium chain saturated fatty acids (C12-C14) that form an emulsion layer denser than water, preventing phase separation and the soap from salting out on the top of the remaining solution.

Our invention preferably uses an emulsifier with surfactant properties composed of a glycerol backbone with no fewer than two side chains, with at least one being a medium to long chain carboxylic acid with good hydrophobic properties, and at least one having moderate hydrophillic properties, preferably of an amphoteric and/or zwitterionic nature. More preferably, this emulsifying agent's chemical composition should resemble that of a lecithin, most preferably that of a soya lecithin.

EXAMPLES

The following methods and examples are provided to illustrate the invention. In the following embodiments, example concentrated mix formulations are provided that are intended to be exemplary, not limiting. The concentrated mixes are novel in that they comprise soap-based formulations that specifically may incorporate lecithin and yield stable liquid laundry cleaning solutions when added to water and mixed in a mixing container. Preferably the concentrated mixes comprise soap-based formulations that include glycerin-containing soaps. Example methods of mixing include those noted here, with these methods applicable to the example formulations presented herein.

Method 1

A first method for mixing the Laundry Cleaner Mix with water is illustrated in FIG. 1. A container that holds dry or liquid concentrated constituents (the Laundry Cleaner "Mix") is opened and emptied into a mixing container or bottle having adequate volume to hold up to 1 fluid gallon; the method may be adapted to smaller volumes such as 1 liter, 1 quart, ½ gallon, and other amounts. Water is added to the dry or liquid concentrated constituents with the resulting mixture stirred or shaken, preferably by hand, to blend the "Mix" with the water. Preferably, about one quart of water is added to the mix; more or less water may be added at this step. Preferably, the water is warm or hot, in a temperature range of 95-130 deg F. The water may be less than 95 deg F. in temperature, although this may lead to the mixture taking a longer time to go into solution than when water of a higher temperature is used. The mixed laundry cleaner is allowed to stand for about 20 minutes prior to use, to allow the ingredients to dissolve and blend in the liquid mixture. The laundry cleaner solution is shaken or stirred well prior to each use. Preferably the shaking or stirring is done by hand, without the use of a powered shaking or stirring means. Such powered means include use of a shear mixing apparatus, use of a powered blender or automating stirrer, or other means where the method is not done by hand by a person. Approximately ¼-1 cup of liquid laundry cleaner is used per large load of laundry, depending upon the dilution of the mix with water.

Method 2

Figure 2:
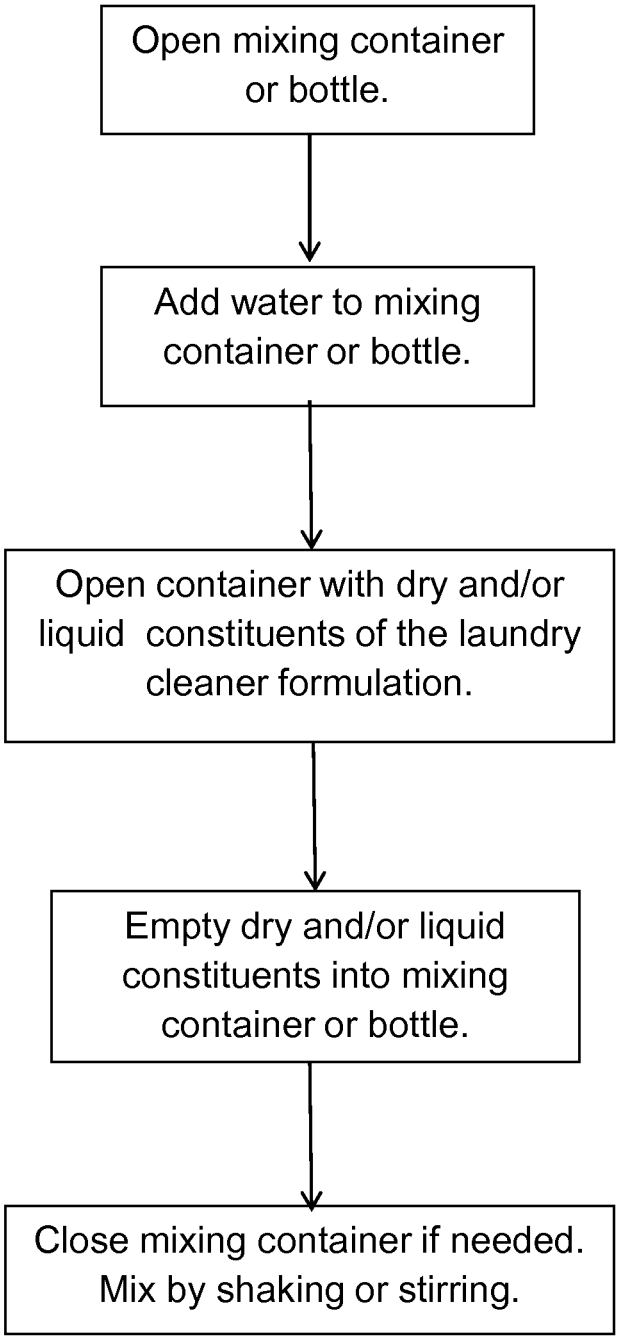
FIG. 2. This figure illustrates a second method of mixing the constituents of a laundry cleaner formulation/mix with water.

A second method for mixing the Laundry Cleaner Mix is illustrated in FIG. 2. This figure illustrates one procedure that may be used, with flexibility in the order of addition of the dry and/or liquid constituents (the Laundry Clean "Mix") and the water.

The mixing container or bottle is opened and a prescribed amount of water is added, with the amount dependent upon the amount of Laundry Cleaner Mix, and the desired dilution of the resulting liquid laundry cleaner. The mixing container or bottle is filled with water sufficient to make up to 1 gallon of liquid laundry cleaner. Preferably, the water is warm, 95-130 deg F. Other volumes and temperatures of water may be used. The container of dry and/or liquid constituents is opened next. This container may consist of an envelope, pouch or other container that will maintain any dry constituents in powdered form until they are opened. The constituents are poured into the water in the mixing container or bottle, with the resulting solution stirred or shaken to thoroughly incorporate the "Mix" into the water. Preferably, the solution in the mixing container or bottle is mixed by shaking, stirring, or similar operation by hand. The laundry cleaner mixture may be allowed to sit for about 20 minutes prior to first use; this time span allows the various constituents to dissolve and mix; a longer time can be used. The container of liquid laundry cleaner is shaken or stirred prior to each use. Approximately ¼-1 cup of liquid laundry cleaner is used per large load of laundry, depending upon the dilution of the "mix" with the water.

Method 3

Figure 3:
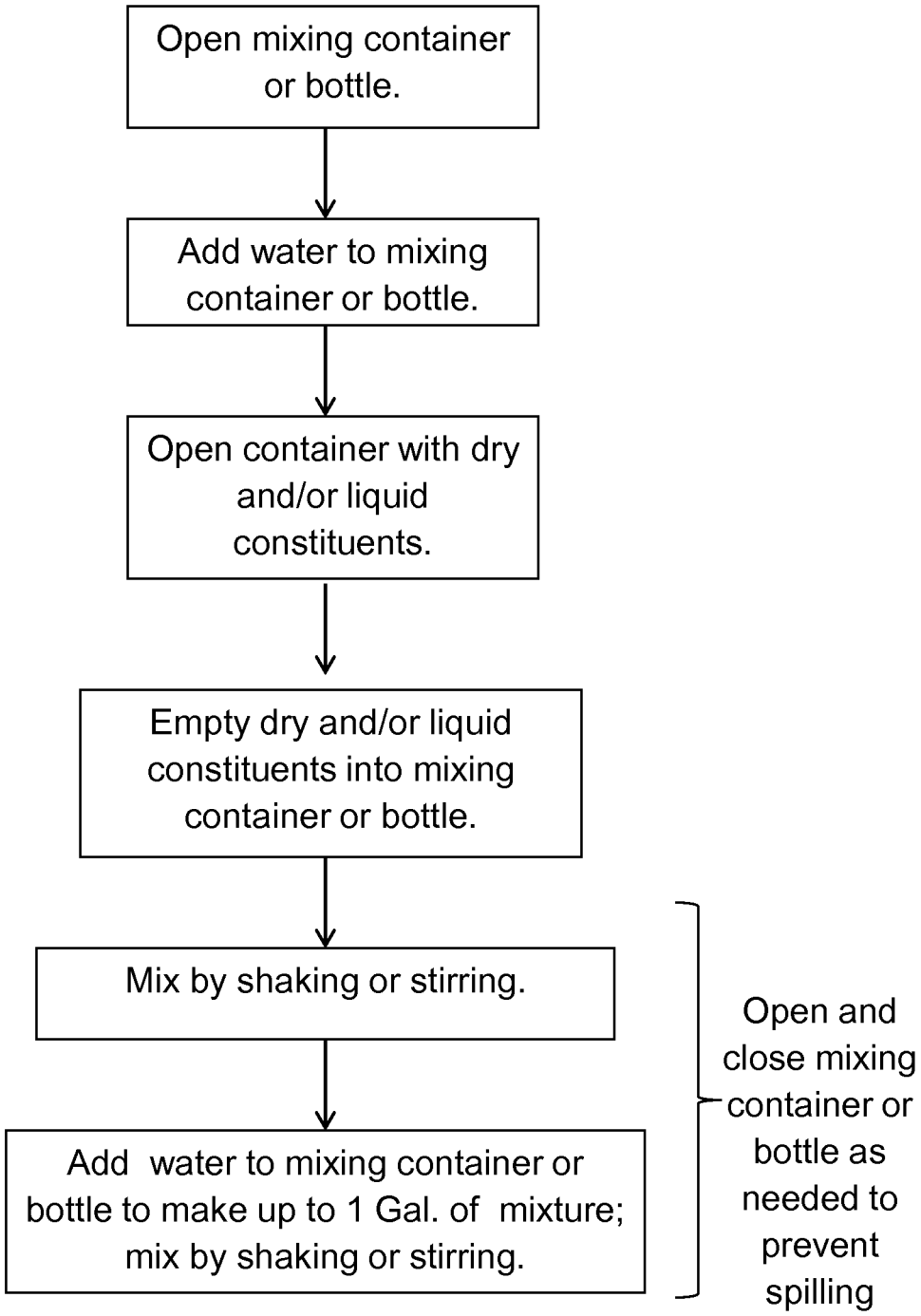
FIG. 3. This figure illustrates a third method of mixing the constituents of a laundry cleaner formulation/mix with water.

A third method for mixing the Laundry Cleaner Mix is illustrated in FIG. 3. This figure illustrates one procedure that may be used by a consumer, with flexibility in the order of addition of the Mix and water.

The mixing container or bottle is opened and a first amount of water is added; this quantity of water is less than the total amount of water that will be added. Preferably, the water is warm, 95-130 deg F. The container of dry and/or liquid constituents is opened next. This container may consist of an envelope, pouch or other container that will maintain any dry constituents in powdered form until they are opened. The constituents are poured into the water in the mixing container or bottle, with the resulting solution stirred or shaken to thoroughly incorporate the "Mix" into the water. The solution in the mixing container is mixed by shaking, stirring, or similar operation, preferably by hand.

A second amount of water is added to the mixture in the mixing container or bottle, filling the mixing container with the appropriate amount of water, up to a liquid volume of 1 gallon. The solution in the mixing container or bottle is mixed once again by shaking, stirring, or similar operation, preferably by hand. Before and after one or more or the additions of water to the mixing container, the container may be opened and closed to allow addition of water, and to seal the container so that the liquid does not spill during mixing.

The laundry cleaner mixture may be allowed to sit for about 20 minutes prior to first use; this time span allows the various constituents to dissolve and mix; a longer time can be used. The container of liquid laundry cleaner is shaken or stirred prior to each use. Approximately ¼-1 cup of liquid laundry cleaner is used per large load of laundry.

Method 4

Figure 4:
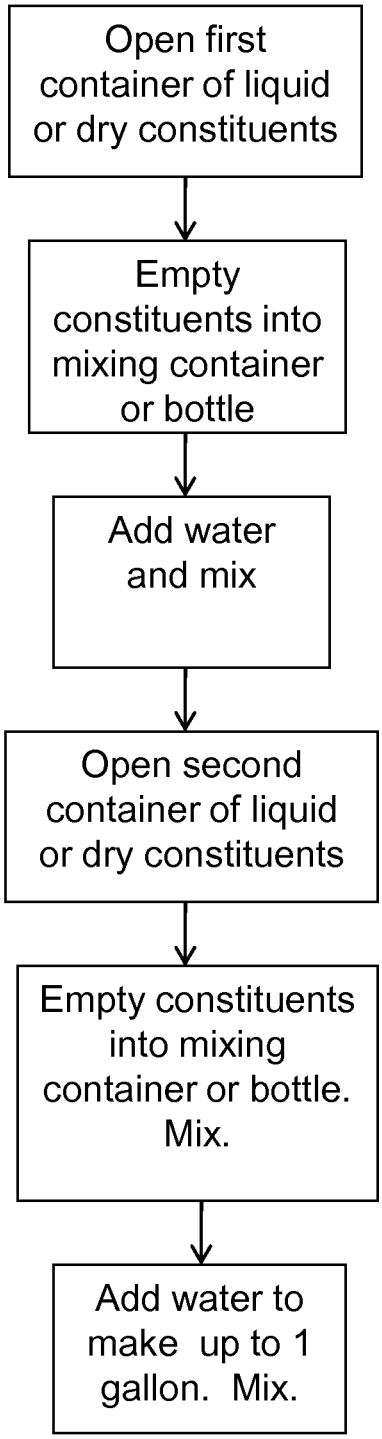
FIG. 4. This figure illustrates a fourth method of mixing the constituents of a laundry cleaner formulation/mix with water.

A fourth method for mixing the Laundry Cleaner Mix is illustrated in FIG. 4. This figure illustrates one procedure that may be used by a consumer, with flexibility in the order of addition of the "Mix" and water. In this method, the "Mix" includes multiple containers of constituents that are separately packaged.

A container of liquid or dry laundry cleaner constituents is first opened and emptied into a mixing container or bottle. The container of liquid or dry constituents may consist of an envelope, pouch or other container. A first amount of water is added; this quantity of water is less than the total amount of water that will be added. Preferably, the water is warm, 95-130 deg F. The resulting solution is stirred or shaken to thoroughly incorporate the first laundry cleaner constituents into the water. Preferably, the stirring and/or shaking are done by hand.

A second container of liquid or dry constituents is opened and emptied into the solution in the mixing container or bottle. A second amount of water is added to the mixture in the mixing container, filling the mixing container with the appropriate amount of water, up to a liquid volume of 1 gallon. The solution in the mixing container is mixed once again by shaking, stirring, or similar operation, preferably by hand. Before and after one or more of the additions of water to the mixing container, the container may be opened and closed to allow addition of water, and to seal the container so that the liquid does not spill during mixing.

The laundry cleaner mixture may be allowed to sit for about 20 minutes prior to first use; this time span allows the various constituents to dissolve and mix; a longer time can be used. The container of liquid laundry cleaner is shaken or stirred prior to each use. Approximately ¼-1 cup of liquid laundry cleaner is used per large load of laundry.

Example 5

Laundry Cleaner Mix with Liquid Soap Component

Ingredients:
1 cup liquid soap
¼ cup washing soda, mixed with ¼ cup of Borax
1 gallon water, approximately, divided
Mixing container or bottle to hold 1 gallon.

Example 6

Laundry Cleaner Mix with Powdered Soap Component

Ingredients:
¼ cup powdered soap
¼ cup washing soda, mixed with ¼ cup of Borax
Water, approximately 1 gallon, divided
Mixing container or bottle to hold 1 gallon.

Example 7

Laundry Cleaner Mix with Powdered Soap Component Version 2

Ingredients:
¼ cup powdered soap
¼ cup washing soda, mixed with ¼ cup of Borax
Water, approximately 1 gallon, divided
Mixing container or bottle to hold 1 gallon.

The laundry cleaners of Examples 5 through 7 may be mixed using any of the Methods 1, 2, 3 or 4.

All of the Examples 5, 6, and 7 produce liquid laundry cleaners wherein the ingredients initially form emulsions within 20-120 minutes of mixing, with mixing done by shaking or stirring, preferably by hand. When tested in wash loads, all of the formulations provide adequate removal of most soils and odors; stain removal may be inadequate, with some stains remaining in the fabric after washing.

Examples 8 and 9

Examples 8.1-8.3 and 9.1-9.4 illustrate laundry cleaner mixes that include one or more enzymes. The examples shown here are specific to the use of powdered enzymes such as "Clean Power", sold by Genencorp. The "Clean Power" product consists of a blend of a protease and an amylase. This blended enzyme, when used in the laundry cleaner mix, dissolves readily with the other components of the formulation when mixed with water.

The laundry cleaner mixes of Examples 8 and 9 may be mixed using any of Methods 1, 2, 3, or 4.

Examples 8

Laundry Cleaner Mix with Enzymes

Ingredients:

| | 1 Qt. Finished Quantity | | |
|---|---|---|---|
| | Ex. 8.1 | Ex. 8.2 | Ex. 8.3 |
| Water (g) | 875 | 875 | 875 |
| Borax (g) | 11 | 11 | 11 |
| Washing Soda (g) | 17 | 17 | 17 |
| Soap (g) | 4 | 4 | 4 |
| Powdered Enzyme (g) | 12 | 6 | 0 |

Examples 9

Laundry Cleaner Mix with Enzymes

Ingredients:

| | 1 Qt. Finished Quantity | | | |
|---|---|---|---|---|
| | Ex. 9.1 | Ex. 9.2 | Ex. 9.3 | Ex. 9.4 |
| Water (g) | 875 | 875 | 875 | 875 |
| Borax (g) | 22 | 11 | 11 | 22 |
| Washing Soda (g) | 17 | 34 | 17 | 34 |
| Soap (g) | 4 | 4 | 8 | 8 |
| Powdered Enzyme (g) | 6 | 6 | 6 | 6 |

The formulations described in both Examples 8 and 9 dissolve in the added water in 10-120 minutes, at water temperatures between 95-103 deg F. Most commonly, the formulations dissolve within 20 minutes, using shaking or stirring by hand.

Examples 10

Laundry Cleaner Mix with Lecithin

Examples 10 may be mixed by any of the mixing methods 1, 2, 3, or 4. When mixed with stirring or shaking by hand, the resulting liquid laundry cleaners initially form emulsions within 10-120 minutes of mixing. However, the emulsions without the lecithin are more likely to "break" within 1-10 days, with the solutions forming gels, aggregates, and/or salting out. In contrast, the solutions with the lecithin are not observed to form gels, aggregates or to demonstrate salting out.

When tested in wash loads, Examples 10A and 10B demonstrate good cleaning, with removal of odors, soils, and stains (grass stain, dirt stains, food stains, not including mustard and catsup). The wash loads cleaned with the liquid laundry cleaner of Example 10B have improved softness relative to the wash cleaned with Example 10A. Surprisingly, this improved softness of fabrics does reduce their water absorption, for example, the water absorption of towels.

| Ingredients: | Example 10A | Example 10B |
|---|---|---|
| Borax | 6 g | 6 g |
| Washing Soda | 8 g | 8 g |
| Soap flakes (Bradford Soap, 100% Sodium Cocoate Soap Base) #816884 Lot 24037, received Jan. 22, 2013 | 3 g | 3 g |
| Enzyme (Genencorp Clean Power, received Jan. 13, 2013) | 3-4 g | 3-4 g |
| Lecithin (organic) | none | 2 g |
| Water | 8 oz, 111° F. | 8 oz, 111° F. |
| Observations: | Solution separates after 4 days | Solution stable for >11 months |

Control: Commercial Granular Detergent

The ability of the inventive formulations to dissolve in up to one gallon of water is compared to the ability of a widely used commercial powdered laundry detergent that is marketed to dissolve readily when used in a High Efficiency (HE) washing machine. HE washers use anywhere from 20 to 60 percent less water than non-HE machines. As a result, these high-efficiency machines require detergents that are specially formulated. HE detergents disperse quickly to remove soil and dirt and prevent it from redepositing onto the items being washed.

Ultra Tide Powder HE laundry detergent was measured into a one pint mixing container (Mason jar), with sufficient granular powder for 4 average washloads. Approximately 10 fluid ounces of 110 deg F-120 deg F water was added to the detergent, with the mixing container closed and shaken vigorously for about 30 seconds. The container was opened and filled to 1 pint, with additional warm water. The mixture was shaken again vigorously for another 30 seconds. When the mixing container was opened, the resulting solution was very thick, with the granular powder largely undissolved, but suspended in the water. The container was closed again, with the mixture allowed to sit for several weeks. Repeated shaking to mix did not improve the dissolution of the granular powder in the water. The mixture forms a slurry, not a solution and not an emulsion.

Control: Soap Dissolution

As a control, three laundry solutions were prepared using different soap products. Each of Fels Naptha, Ivory, and all-natural soap (made from olive oil, water, lye, palm oil, coconut oil and shortening) were grated to produce finely grated soap. As noted in the table that follows, the all-natural soap produced particles with a longest dimension no longer than 2 mm, and a narrow dimension typically smaller than 1 mm. In contrast, the Fels Naptha and Ivory soaps produced longer particles of soap when grated, with lengths more commonly up to 1 cm and widths of about 1 mm. The all-natural soap could not be grated into larger particles; even when prepared with a coarse grater the all-natural soap produces particles with no dimension larger than 2 mm, and most particles with no dimension larger than 1 mm.

To produce the control liquid laundry cleaners, 3 clean glass quart-size Mason jars were used. To each jar were added 11 g of Borax, 17 g of Washing Soda, and 2 g of the grated soap (all-natural, Fels Naptha, or Ivory). These dry constituents were dissolved by adding approximately 2 cups of warm tap water (109-110 deg F) to each Mason jar, capping and shaking each jar for 15 seconds. The Mason jars were opened, with enough warm tap water added to fill each jar to within 1 inch of the top. The jars were recapped and each shaken again for 10 seconds. The laundry cleaning solutions were allowed to rest for 10 minutes, then observed to note the dissolution and mixing of the liquids. The results are listed in the table that follows. As noted in the table, all of the solutions had some undissolved Borax, resulting from clumps of dry Borax that were not broken up prior to mixing. While the finely grated all-natural soap was fully dissolved after ten minutes, both the Fels Naptha and Ivory soaps remained undissolved, with the particles of soap floating on the surface of the laundry cleaner solutions. The three jars of laundry cleaner were recapped and each shaken for 15 seconds, then allowed to rest for another 10 minutes. After this second ten minute period, more of the Borax had dissolved, but the Fels Naptha and Ivory soaps remained floating on the surfaces of the cleaning solutions.

| Soap | Notes |
|---|---|
| All-Natural: grated soap particles were 2 mm max in length, with all smaller than 1 mm in width; most were smaller. Soap has a dry, powdery feeling. | Soap and other ingredients completely dissolved after 10 minutes, except large clumps of Borax that were not previously broken apart. |
| Ivory: grated soap particles were up to about 1 cm in length, and up to 1 mm in width. Soap has a moist and waxy feeling; a softer soap relative to the all-natural. | Soap was not completely dissolved -- still see the soap pieces floating on top of the solution. All other ingredients dissolved, except large clumps of Borax that were not previously broken apart. |

-continued

| Soap | Notes |
|---|---|
| Fels Naptha: grated soap particles were up to about 1 cm in length, and up to 1 mm in width. Soap has a waxy feeling; a softer soap relative to the all-natural, but not as moist relative to the Ivory. | Soap was not completely dissolved -- still see the soap pieces floating on top of the solution. All other ingredients dissolved, except large clumps of Borax that were not previously broken apart. |

Having thus described several embodiments of the claimed invention, it will be apparent to those skilled in the art that the foregoing detailed disclosure is intended to be presented by way of example only, and is not limiting. Various alterations, improvements, and modifications will occur to those skilled in the art, though not expressly stated herein. These alterations, improvements, and modifications are intended to be suggested hereby, and are within the spirit and the scope of the claimed invention. Additionally, the recited order of the mixing procedures is not intended to limit the claimed processes to any order except as may be specified in the claims. Accordingly, the claimed invention is limited only by the following claims and equivalents thereto.

The invention claimed is:

1. A concentrate formulation for forming a stable colloidal laundry cleaner consisting of a wt % basis of 0%-20% protease, 0%-20% amylase, 1-20% lecithin, 5%-20% soap, 15%-50% borax decahydrate, and 20%-70% sodium carbonate monohydrate, and optionally water.

2. The concentrate formulation of claim 1, wherein the total combined protease and amylase make up no more than 30% by weight of the formulation.

3. The concentrate formulation of claim 1, wherein the soap is one or more of the sodium salts of carboxylic acids ranging from C6 to C18.

4. The concentrate formulation of claim 1, wherein each of the protease, amylase, lecithin, soap, borax decahydrate, and sodium carbonate monohydrate are in a powder, flake, or granular form.

5. The concentrate formulation of claim 1 further consisting of water for forming the stable colloidal laundry cleaner, wherein the water is from 75 wt % to 98 wt % of the stable colloidal laundry cleaner.

6. The concentrate formulation of claim 1 further consisting of water for forming the stable colloidal laundry cleaner, wherein the water is from 92 wt % to 98 wt % of the stable colloidal laundry cleaner.

7. The concentrate formulation of claim 1, wherein the soap includes at least 1 part in 10 by molar ratio of glycerin relative to the fatty acid content of 15 the soap.

* * * * *